US009680255B2

(12) United States Patent
Schrader

(10) Patent No.: US 9,680,255 B2
(45) Date of Patent: Jun. 13, 2017

(54) PLUG CONNECTOR HAVING A LATCHING SYSTEM

(71) Applicant: Phoenix Contact GmbH & Co. KG, Blomberg (DE)

(72) Inventor: Andreas Schrader, Delbrueck (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/029,634

(22) PCT Filed: Oct. 17, 2014

(86) PCT No.: PCT/EP2014/072370

§ 371 (c)(1),
(2) Date: Apr. 15, 2016

(87) PCT Pub. No.: WO2015/055845

PCT Pub. Date: Apr. 23, 2015

(65) Prior Publication Data

US 2016/0248199 A1 Aug. 25, 2016

(30) Foreign Application Priority Data

Oct. 18, 2013 (DE) ..... 10 2013 111 506

(51) Int. Cl.
*H01R 13/627* (2006.01)
*H01R 13/50* (2006.01)

(52) U.S. Cl.
CPC ..... *H01R 13/6273* (2013.01); *H01R 13/501* (2013.01)

(58) Field of Classification Search
CPC ..... H01R 13/6273; H01R 13/501; H01R 13/6275
USPC ..... 439/345, 347, 350–352, 354, 357–358, 439/372
See application file for complete search history.

(56) References Cited

U.S. PATENT DOCUMENTS 4,961,711 A * 10/1990 Fujiura ..... H01R 23/6873 439/357
5,941,726 A * 8/1999 Koegel ..... H01R 13/6275 439/354
6,146,183 A 11/2000 Jinno et al.
6,149,451 A * 11/2000 Weber ..... H01R 13/6275 439/358
6,364,685 B1 4/2002 Manning
6,736,663 B2 * 5/2004 Lee ..... H01R 13/6275 439/353

(Continued)

FOREIGN PATENT DOCUMENTS

DE 69907371 T2 12/2003
EP 1533872 A1 5/2005
JP 0227674 A 1/1990

(Continued)

*Primary Examiner* — Edwin A. Leon
(74) *Attorney, Agent, or Firm* — Leydig, Voit & Mayer, Ltd.

(57) ABSTRACT

A plug-in connector includes a latching system, for being received in and latched to an additional plug-in connector. The latching system is arranged on a connector housing and comprising at least one latching tab having a latching lug. The latching tab includes a pressure tab that can be positioned against the connector housing in order to exert a spring force.

8 Claims, 3 Drawing Sheets

(56) References Cited

U.S. PATENT DOCUMENTS

| | | | |
|---|---|---|---|
| 7,232,329 | B1 | 6/2007 | Wu |
| 2001/0035652 | A1 | 11/2001 | Wada et al. |

FOREIGN PATENT DOCUMENTS

| | | | |
|---|---|---|---|
| JP | H 06168759 | A | 6/1994 |
| JP | 0968628 | A | 3/1997 |
| JP | 2001250636 | A | 9/2001 |
| KR | 940009371 | B1 | 10/1994 |

* cited by examiner

PLUG CONNECTOR HAVING A LATCHING SYSTEM

CROSS REFERENCE TO RELATED APPLICATIONS

This application is a U.S. National Stage Application under 35 U.S.C. §371 of International Application No. PCT/EP2014/072370 filed on Oct. 17, 2014, and claims benefit to German Patent Application No. DE 10 2013 111 506.3 filed on Oct. 18, 2013. The International Application was published in German on Apr. 23, 2015 as WO 2015/055845 A1 under PCT Article 21(2).

FIELD

The invention relates to a plug-in connector comprising a latching system, for being received in and latched to an additional plug-in connector.

BACKGROUND

In the field of electrical engineering, various plug-in connectors having latching systems are known. Plug-in connectors of this kind can be inserted into a base strip and can be latched to the base strip by an additional fixture, for example by a latching tab that can be placed or stuck thereon. The latching force of a latching tab of this kind can be varied by modifying the length and pitch of the pressure tab. However, a disadvantage of this is that the latching tab is not directly connected to the housing of the plug-in connector and an additional working step is therefore required to latch the plug-in connector to the base strip.

Furthermore, plug-in connectors are known in which the latching tab is arranged integrally on the housing. However, a problem with plug-in connectors of this kind is that the latching tab can be deformed during the injection moulding production process of the plug-in connector, and therefore the latching tab cannot exert the corresponding latching force that is required for latching to the base strip.

SUMMARY

In an embodiment, the present invention provides a plug-in connector including a latching system configured to be received in and latched to an additional plug-in connector, the latching system being arranged on a connector housing and comprising a latching tab having a latching lug. The latching tab includes a pressure tab that can be positioned against the connector housing in order to exert a spring force.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
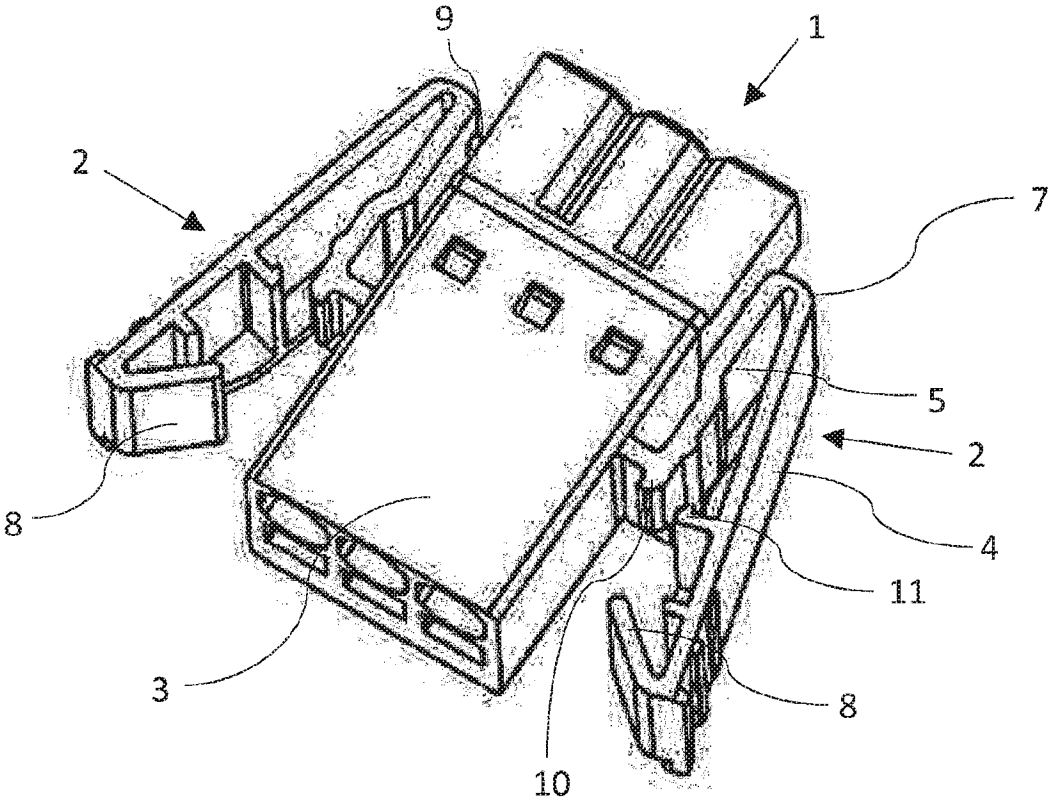
FIG. 1 is a three-dimensional view of a plug-in connector having a V-shaped latching tab according to an embodiment of the invention.

An embodiment of the invention provides a plug-in connector having a latching system, in which the latching force of the latching system is not adversely affected by the production process of the plug-in connector.

According to an embodiment of the invention, a plug-in connector comprising a latching system, for being received in and latched to an additional plug-in connector, is provided, the latching system being arranged on the connector housing and comprising at least one latching tab having a latching lug, characterised in that the latching tab has a pressure tab that can be positioned against the connector housing in order to exert a spring force.

Therefore, the pressure tab of the latching tab is not already directly connected to the connector housing during the production process of the plug-in connector. The pressure tab exerts the spring force only when the pressure tab is positioned against the connector housing. In this way, during the production process of the plug-in connector the pressure tab is not subjected to any prestress that is relevant for the subsequent spring force of the latching tab. In addition, the pressure tab can be adjusted during the production process, depending on the planned latching force to be exerted by the latching tab.

In an embodiment of the invention, the latching tab is V-shaped and comprises an outer leg and an inner leg that is shorter than the outer leg.

Furthermore, in an embodiment of the invention the inner leg is joined at the first end thereof to the connector housing by means of a joining bridge, and is connected at the second end thereof to the second end of the outer leg by means of a film hinge.

In an embodiment of the invention the pressure tab is arranged at the first end of the outer leg on the side facing the connector housing.

Furthermore, in an embodiment of the invention the latching lug of the latching tab is arranged at the second end of the inner leg on the side facing the connector housing.

In an embodiment of the invention the inner leg has a latching region on its first end and the outer leg has, on its side facing the inner leg, a latching hook for latching to the latching region of the inner leg, the pressure tab being able to be positioned against the connector housing by latching the latching hook into the latching region. In this way, the spring force of the pressure tab is exerted only by the latching hook being latched to the latching region. Therefore, a plug-in connector comprising a latching system is provided, in which the latching force of the latching system can only be activated at a later point. This is relevant in particular in the manufacturing process of the plug-in connector comprising the latching system since, inter alia, temperature-dependent method steps do not considerably affect the prestressing of the latching tab achievable by the spring force.

In this context, in an embodiment of the invention the inner side of the outer leg abuts the inner leg when the latching hook latches to the latching region. In this way, force can be transferred between the outer leg and the inner leg.

Furthermore, in an embodiment of the invention the spring force of the pressure tab exerts a force towards the connector housing in the region of the latching lug. In this way, the latching lug is pressed onto the connector housing, as a result of which the latching effect of the latching system is increased.

According to another embodiment of the invention, the pressure tab is inclined towards the inner leg and is at an angle of between approximately 30° and approximately 60° in relation to the axis of the outer leg. In this way, it is possible to adjust the spring force of the pressure tab in the tool by changing the inclination angle of the pressure tab. As well as changing the inclination angle in order to adjust the spring force of the pressure tab, the spring force of the pressure tab can also be adjusted by changing the length of the pressure tab.

Furthermore, in another embodiment of the invention the latching tab can be moved away from the connector housing in the region of the latching lug by means of a force acting counter to the spring force of the pressure tab. In this way, the latching of the plug-in connector that is inserted into the additional plug-in connector and latched to the additional plug-in connector is released so that the plug-in connector can be unplugged from the additional plug-in connector.

In an embodiment of the invention, the plug-in connector is formed integrally with the latching system. In this way, a plug-in connector comprising a latching system is provided, in which the latching force of the latching system is not adversely affected by the production process of the plug-in connector, and moreover, no additional working step for latching is required in addition to inserting the plug-in connector into the additional plug-in connector.

Finally, in an embodiment of the invention, the latching system comprises a plurality of latching tabs. In this way, particularly secure latching of the plug-in connector to the additional plug-in connector is provided.

FIG. 1 shows a plug-in connector 1 comprising a latching system, the latching system comprising a first latching tab 2 and a second latching tab 2, which is identical to the first latching tab 2. Since the first latching tab 2 and the second latching tab 2 are identical, and the first latching tab 2 and the second latching tab 2 are arranged symmetrically on the connector housing 3 of the plug-in connector 1, the design of the latching system is described on the basis of one latching tab 2.

The latching tab 2 is V-shaped and comprises an outer leg 4 and an inner leg 5 that is shorter than the outer leg 4. The inner leg 5 is joined at the first end thereof to the connector housing 3 by means of a joining bridge 6 and is connected at the second end thereof to the second end of the outer leg 4 by means of a film hinge 7.

The outer leg 4 has, on its side facing the connector housing 3, a pressure tab 8 inclined towards the inner leg 5. The inclination angle of the pressure tab is approximately 30° in relation to the axis of the outer leg 4.

It can furthermore be seen that a latching lug 9 for latching to an additional plug-in connector 12 is arranged at the second end of the inner leg 5 on the side facing the connector housing 3. In addition, the inner leg 5 has a latching region 10 on its first end and the outer leg 4 has, on its side facing the inner leg, a latching hook 11 for latching to the latching region 10 of the inner leg 5.

Figure 2:
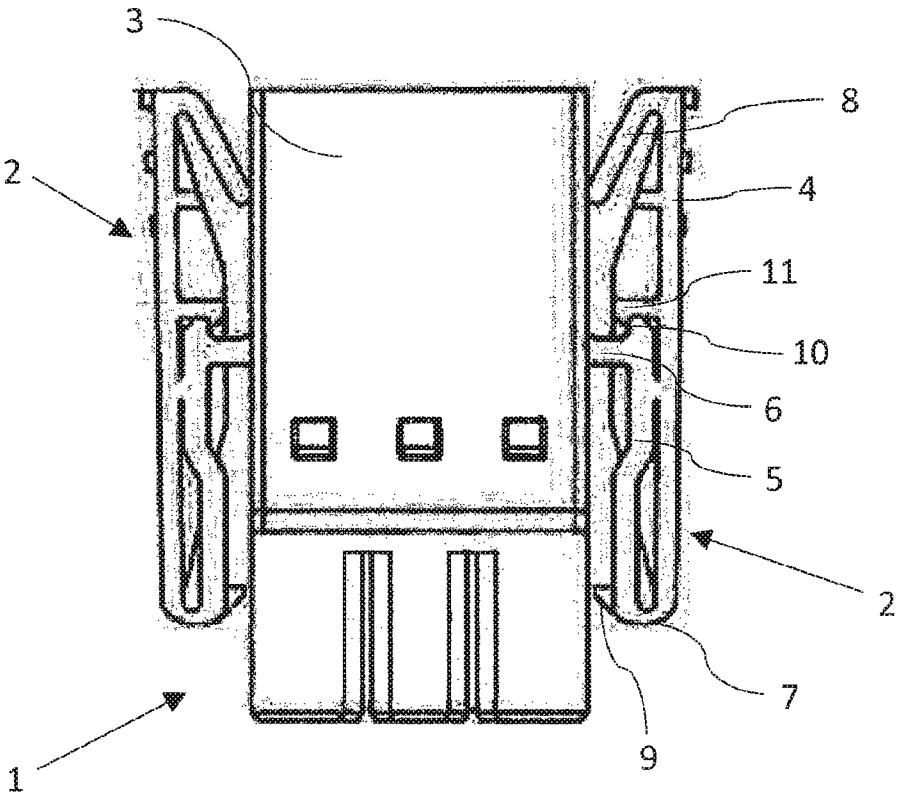
FIG. 2 is a plan view of the plug-in connector having a pressure tab positioned against the connector housing according to an embodiment of the invention.

As FIG. 2 shows, the latching hook 11 of the outer leg 4 is latched to the latching region 10 at the first end of the inner leg 5. In this way, the pressure tab 8 arranged on the first end of the outer leg 4 is positioned against the connector housing 3.

It can furthermore be seen that, as a result of the latching hook 11 latching to the latching region 10, the inner side of the outer limb 4 contacts the inner limb 5. In this way, the spring force of the pressure tab 8 generated by positioning the pressure tab 8 against the connector housing 3 is transferred to the inner leg 5 as far as to the latching lug 9 by means of the outer leg 4 and the latching hook 11 latched to the latching region 10.

The joining bridge 6 for joining the inner leg 4 to the connector housing 3 acts as a pivot point, and so the spring force exerted by the pressure tab 8 exerts a force towards the connector housing 3 in the region of the latching lug 9.

Figure 3:
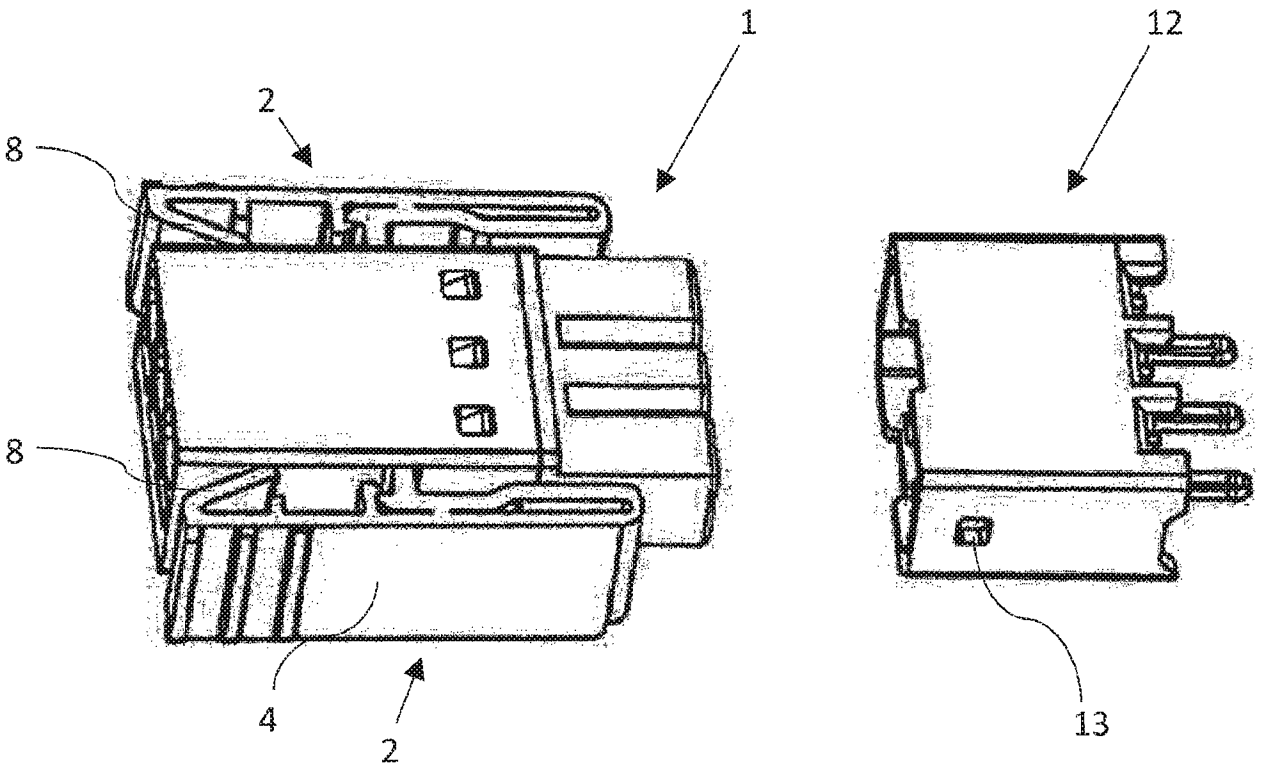
FIG. 3 is a three-dimensional view of the plug-in connector for being received in and latched to an additional plug-in connector according to an embodiment of the invention.

FIG. 3 shows the plug-in connector 1 comprising the latching system for being received in and latched to an additional plug-in connector 12. The pressure tab 8 of each latching tab 2 abuts the connector housing 3. The spring force exerted by the pressure tab 8 causes a force towards the connector housing 3 in the region of the latching lug 9. By inserting the plug-in connector 1 into the additional plug-in connector 12, the latching lug 9 shown in FIG. 2 latches into a corresponding recess 13 in the additional plug-in connector 12.

By applying a force that to the first end of the outer leg 4 from the outside and that acts counter to the spring force exerted by the pressure tab 8, the latching tab 2 can be moved away from the connector housing 3 in the region of the latching lug 9. In this way, the latching of the plug-in connector 1 that is inserted into the additional plug-in connector 12 and latched to the additional plug-in connector 12 is released so that the plug-in connector 1 can be unplugged from the additional plug-in connector 12.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMERAL LIST

1 plug-in connector
2 latching tab

3 connector housing
4 outer leg
5 inner leg
6 joining bridge
7 film hinge
8 pressure tab
9 latching lug
10 latching region
11 latching hook
12 additional plug-in connector
13 recess

The invention claimed is:

1. A plug-in connector comprising:

a latching system configured to be received in and latched to an additional plug-in connector, the latching system being arranged on a connector housing and comprising a latching tab having a latching lug, wherein the latching tab includes a pressure tab that can be positioned against the connector housing in order to exert a spring force, wherein the latching tab is V-shaped and comprises an outer leg and an inner leg, the inner leg being shorter than the outer leg, wherein the inner leg is joined at a first end thereof to the connector housing by a joining bridge, and wherein the inner leg is connected at a second end thereof to a second end of the outer leg by a film hinge.

2. The plug-in connector according to claim 1, wherein the pressure tab is arranged at the first end of the outer leg on the side facing the connector housing.

3. The plug-in connector according to claim 1, wherein the latching lug of the latching tab is arranged at the second end of the inner leg on the side facing the connector housing.

4. The plug-in connector according to claim 1, wherein the inner leg has a latching region on its first end and the outer leg has, on a side facing the inner leg, a latching hook for latching to a latching region of the inner leg, wherein the pressure tab is configured to be positioned against the connector housing by latching the latching hook into the latching region.

5. The plug-in connector according to claim 1, wherein the spring force of the pressure tab exerts a force towards the connector housing in a region of the latching lug.

6. The plug-in connector according to claim 1, wherein the pressure tab is inclined towards the inner leg.

7. The plug-in connector according to claim 1, wherein the plug-in connector is formed integrally with the latching system.

8. The plug-in connector according to claim 1, wherein the latching system comprises a plurality of latching tabs.

* * * * *